US006848202B2

(12) United States Patent
Berggren

(10) Patent No.: US 6,848,202 B2
(45) Date of Patent: Feb. 1, 2005

(54) ARRANGEMENT FOR THE UPPER PART(S) OF A SHOE

(76) Inventor: Svante Berggren, Strandvägen 10, Furusjö, SE-566 91 Habo (SE)

( * ) Notice: Subject to any disclaimer, the term of this patent is extended or adjusted under 35 U.S.C. 154(b) by 164 days.

(21) Appl. No.: 10/169,540

(22) PCT Filed: Jan. 8, 2001

(86) PCT No.: PCT/SE01/00022

§ 371 (c)(1),
(2), (4) Date: Jun. 28, 2002

(87) PCT Pub. No.: WO01/49141

PCT Pub. Date: Jul. 12, 2001

(65) Prior Publication Data

US 2003/0056395 A1 Mar. 27, 2003

(30) Foreign Application Priority Data

Jan. 7, 2000 (SE) ..... 0000053

(51) Int. Cl.[7] ..... A43B 3/26
(52) U.S. Cl. ..... 36/97; 36/15; 36/9 R
(58) Field of Search ..... 36/97, 15, 9 R

(56) References Cited

U.S. PATENT DOCUMENTS 1,894,561 A * 1/1933 Guiffre ..... 36/11.5
2,513,005 A * 6/1950 Crawford ..... 36/11.5
3,057,086 A * 10/1962 Rigsby ..... 36/97
4,136,468 A 1/1979 Munschy
4,279,083 A 7/1981 Dilg
4,486,965 A * 12/1984 Friton ..... 36/50.1
5,088,128 A * 2/1992 Kape ..... 2/269
5,699,629 A 12/1997 Munschy

FOREIGN PATENT DOCUMENTS

GB 2156651 10/1985

* cited by examiner

*Primary Examiner*—Ted Kavanaugh
(74) *Attorney, Agent, or Firm*—Orum & Roth

(57) ABSTRACT

The invention relates to an upper part for a shoe, in which the dimensional design of its inside and outside provides considerable adjustability through assembly with fastening devices positioned and construction in such a way that it gives a highly stable upper part, the characteristics of which in terms of material and properties permit is adaptation to different sizes of feet. The upper part of the shoe is in the form of woven fabric or some other flexible material, the fastening devices are in the form of hook and loop-type fastening devices such as VELCRO, at least some of which exhibit circular form, and the under side of the outside of the upper part of the shoe exhibits connecting devices essentially for its detachable attachment to a sole or other under part of the shoe capable of being placed in contact with a floor.

31 Claims, 6 Drawing Sheets

ARRANGEMENT FOR THE UPPER PART(S) OF A SHOE

This application is a 371 of PCT/SE01/00022 filed on Jan. 8, 2001.

BACKGROUND OF THE INVENTION

Field of the Invention

The present invention relates to an arrangement which functions as the upper part(s) for a conventional shoe or for specially manufactured shoes for certain purposes, for example a sport shoe.

A shoe previously disclosed in U.S. Pat. No. 5,699,629 A exhibits the possibility of adjusting the rear heel part of the shoe as well as a front part, which bridges the front instep part of the foot in the same way as in a sandal. Hook and loop fastening devices, such as VELCRO, are used to attach the free ends of the upper part of the shoe. The upper part of the shoe is securely attached to a rigid sole. The sole is stiff, and thus adaptation of the upper part of the shoe to different sizes of feet is not possible. The shoe is designed to be capable of being adapted to different degrees of swollen feet, i.e. only the width is adjustable. Further, these shoes are no lighter than ordinary sandals or slippers.

The principal object of the present invention is thus, to solve the aforementioned problems, among others, by providing a light weight shoe part that adjusts in length as well as width.

SUMMARY OF THE INVENTION

The invention relates to the upper part of a shoe. The function of the invention is to enclose the foot in a supporting and durable fashion that is adjustable for various sizes of feet. The invention relates to fastening arrangements for this purpose. The inventive upper part also provides a fastening arrangement for attachment to the under part(s) of the shoe, i.e. the soles(s), which is/are the part(s) on which the foot rests when standing and during various forms of movement.

The inventive upper shoe part is preferably a woven fabric-like material. The material may be any thickness such as a very thin and extremely light material or a thicker and thus heavier material. Material should have good tensile strength in terms of its ductility/rigidity. The invention must also be capable of being used in different environments, for example heat, cold and damp. Examples of materials used in the upper part include woven fabric, rubber, cardboard, cloth, leather and plastic.

Adjustability is an important aspect of the inventive upper shoe part. This permits the position of the foot on the under part(s) to be varied by means of fastening arrangement mechanisms consisting primarily of a felt hook and loop system, such as VELCRO. The fastening mechanism functions in relation to the toe, front, arch and heel of the foot. The invention can be readily attached to the under part(s), sole or sole parts of most shoes. It is also suitable for use with inventor's own earlier shoe invention disclosed in WO 98/27839.

The problem of damage is always associated with conventional shoes. One purpose of the present invention is to reduce damage. The ability of the inventive upper part to be adapted in an optimal fashion to various foot sizes, the position of the foot on the under part/outsole and the extremely low weight of the material, prevent damage to the shoe.

The inventive upper part of a shoe is characterized essentially in that the upper part of the shoe is in the form of woven fabric or some other flexible material, in that the fastening devices are in the form of hook and loop fastening devices, such as VELCRO at least some of which exhibit circular form, and in that the under side of the outside of the upper part of the shoe exhibits connecting devices for detachable attachment to a sole or other under part of the shoe capable of being placed in contact with a floor.

The function depends on having a very durable upper part. The shoe is optimally adapted to the foot and thus optimally adapted to the individual wearer by use of an under part, such as a conventional shoe sole. The under part is capable of removal, for example to enable it to be washed, and of being replaced, for example as a treatment shoe with no left and no right, or as a special shoe for sports use, and to make the upper part permanent. The upper part is thus able to exhibit all adjustment possibilities and a more limited opening, which then resembles a conventional upper part with left and right fitting.

The upper part uses the circular form of hook and loop attachments such as VELCRO. The circular form—unlike straight strips—ensures that no part pulls out of alignment and that the foot sits perfectly. One can expect to see molded, stocking-like envelopes in the near future, although these are likely to be difficult to adjust. If one wishes to have increased tightening pressure at any point on the foot, using hook and loop circles makes this possible.

The inventive upper part is made of woven fabric, parts of which can be given increased extendability, which can then increase the comfort.

The inventive upper part can be made extremely light, at 10–20 grams, for track running, and increasingly thick and heavier for extreme conditions, such as outdoor activities and hiking, etc.

The weight reduction has a damage preventing effect. The adjustment, which adapts the shoe to the individual, gives the foot the freedom to work for itself.

The inventive upper part of a shoe is inexpensive and simple to produce. The carbon fiber under part, however, is not as simple and inexpensive to produce.

BRIEF DESCRIPTION OF THE DRAWINGS

The function of the invention is described below with reference to the accompanying drawings, in which.

DETAILED DESCRIPTION OF THE INVENTION

Figure 1:
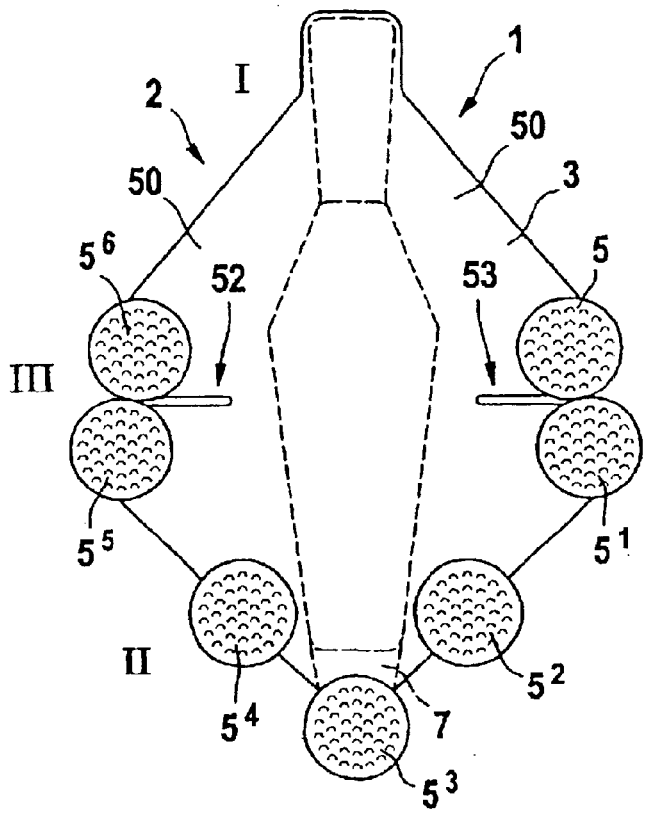
FIG. 1 shows the invention viewed from the inside, illustrating the left and right parts of the upper part and the toe and heel parts in an unfolded, but no assembled, position.
Figure 2:
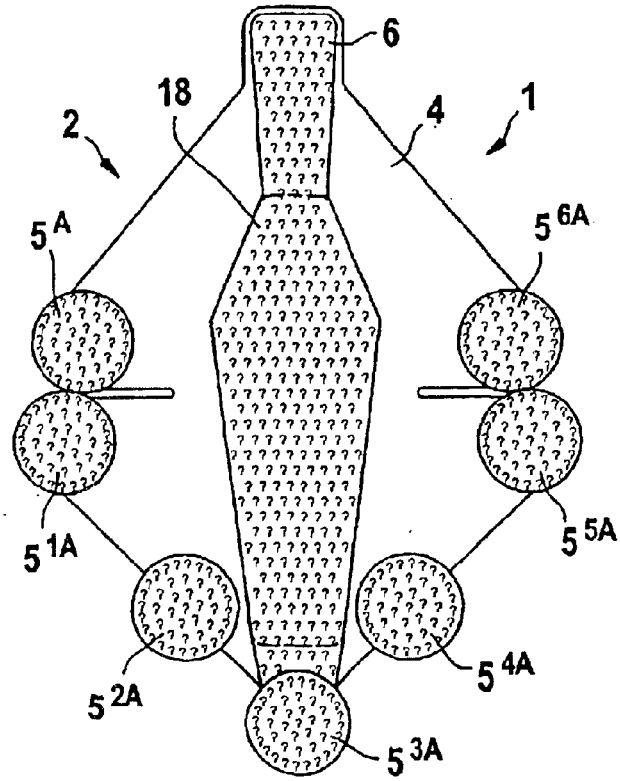
FIG. 2 shows the upper part viewed from the under part with the left and right parts of the outside and the toe and heel parts of the outside in an unfolded, but not assembled, position.

The invention has a large market in the leisure field, in competitive sport and as a treatment shoe in the health care sector.

The inventive upper part for a shoe has many advantages including: an identical part may be used for the left and the right shoe, low weight, adjustability for a number of different sizes, permanently or detachably attached to the under part of a shoe. The upper part consists essentially of a woven fabric material capable of withstanding heat, cold, damp and heavy use, such as that encountered in orienteering.

In accordance with a first embodiment of the invention the upper part(s) 2 of a shoe intended is to be attached to different designs of the under part(s), sole or sole parts of shoes. The upper part 2 exhibits an inside 3, i.e. the side of the upper part 2 which are intended to make contact with a person's foot 10 with the foot correctly positioned therein, and which exhibits an outside 4 which forms the under side that is applied to the under part(s) or sole/sole parts of a conventional or special shoe, and which also forms the left and right outside of the shoe and the outside of the heel.

Fastening devices, 5, $\mathbf{5}^1$, $\mathbf{5}^2$, $\mathbf{5}^3$, $\mathbf{5}^4$, $\mathbf{5}^5$, $\mathbf{5}^6$, $\mathbf{5}^A$, $\mathbf{5}^{1A}$, $\mathbf{5}^{2A}$, $\mathbf{5}^{3A}$, $\mathbf{5}^{4A}$, $\mathbf{5}^{5A}$, $\mathbf{5}^{6A}$ connect together the inside 3 of the upper part consisting of, for example, eye-formed soft attachment elements, preferably circular in shape, with the outside 4 consisting of, for example, hook-shaped, sharper attachment elements, preferably circular in shape. Lacing systems or straps can also be used with attachment points on the upper side and the heel part of the foot. The advantage of fastening devices 5, 4 of the hook and loop type such as VELCRO is that today's hook and loop systems are highly resistant to wear and permit more than 3000 openings/closings. The hook and loop mechanism is also easy to replace.

Figure 3:
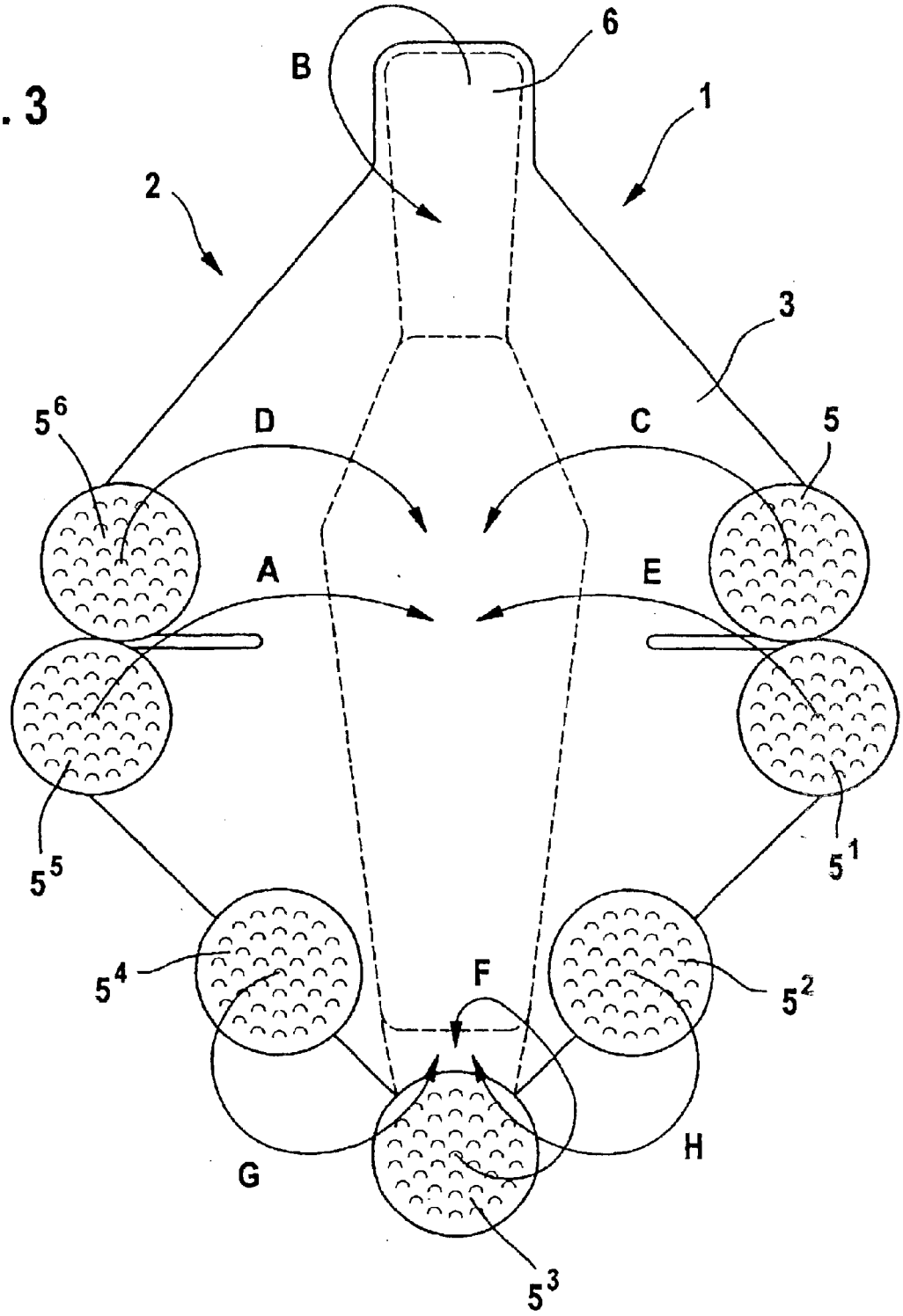
FIG. 3 shows the steps in the assembly of the invention to form a functioning envelope, i.e. a shoe-like upper part.
Figure 4:
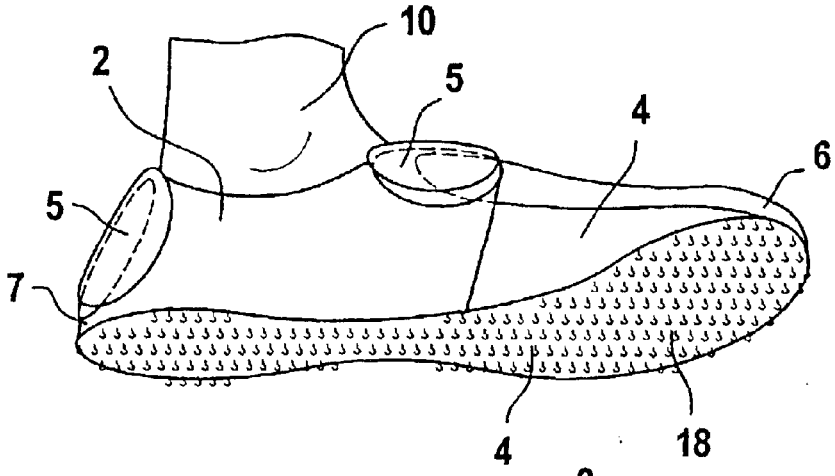
FIG. 4 shows a side view of the inside, at an angle from below and not attached to an under part.
Figure 5:
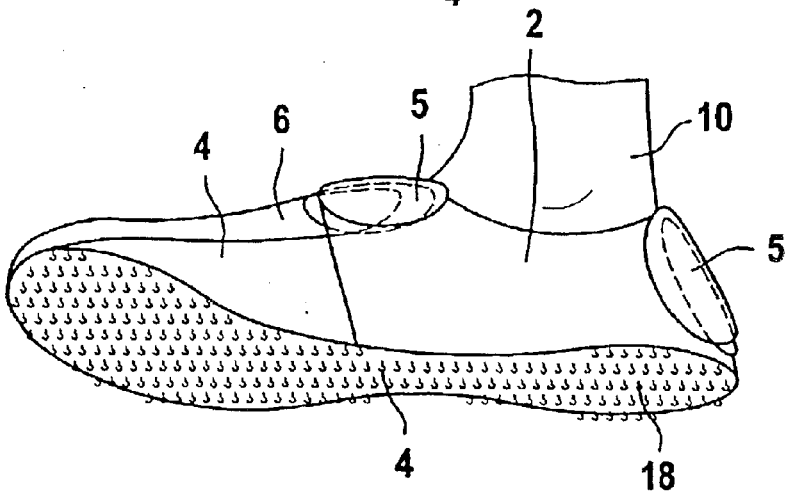
FIG. 5 shows a side view of the outside, at an angle from below and not attached to an under part.
Figure 6:
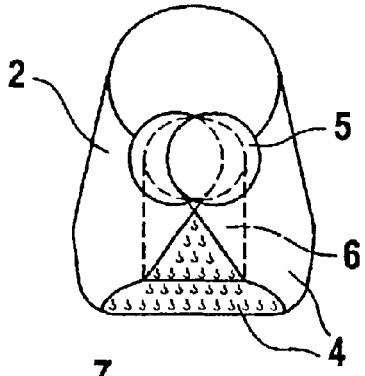
FIG. 6 shows a toe part viewed from the front.
Figure 7:
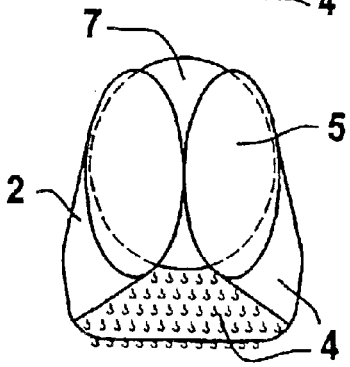
FIG. 7 shows a heel part viewed from the rear.
Figure 8:
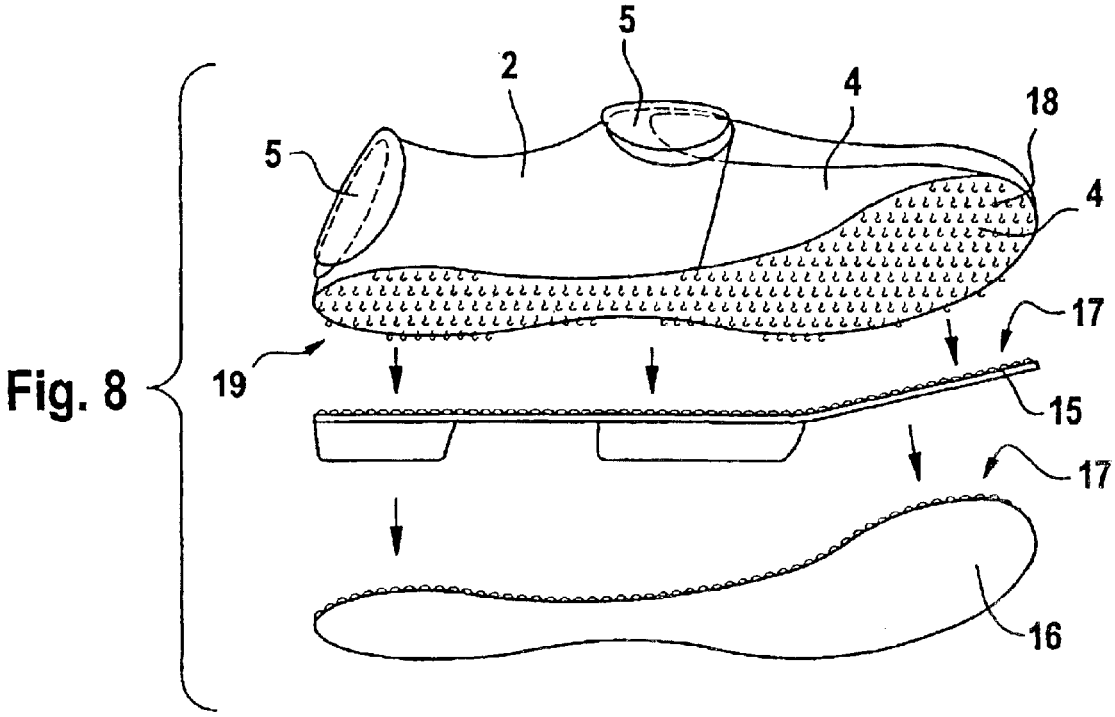
FIG. 8 shows how the upper part is attached to the under part(s) and sole/sole parts.

Folding and fastening of the upper part 2 of the shoe can take place appropriately in the sequence indicated by the letters A–H in the order shown in FIG. 3.

By virtue of their design, the fastening devices 5–$\mathbf{5}^{6A}$ can accommodate a range of shoe sizes from approximately 37–44, for example size M for the upper part 2 and increasing dimensions L for sizes 45 and above. Upper part 2 size S, for example for shoe sizes 36 and smaller.

Present in the upper part 2 at the front is a folding toe part 6, and at the rear a folding heel part 7.

The dimensional design of the upper part 2 means that the same dimensional design can be used for both the left foot and the right foot.

Application of the upper part 2 of the shoe to an under part 15, 16 of a shoe is effected with the under side 4 of the upper part 2 and can be performed using previously disclosed technology including: adhesive, sewing, molding and screws, etc., although it is preferably effected with hook and loop-type fasteners, such as VELCRO. The under part 15/16 is then covered with the felt part 17 i.e. the loops, and is pressed together with the under side 4 of the upper part 2, which is covered with hooks. This now forms a fully functional shoe 19.

Numerous advantages are associated with the above invention and its adaptation to conventional and special shoes, of which the invention of WO 98/27839 is an example, including that the invention is a sample durable assembly; it is adjustable, it has reduced weight and provides maximum adaptation to the individual.

Figure 9:
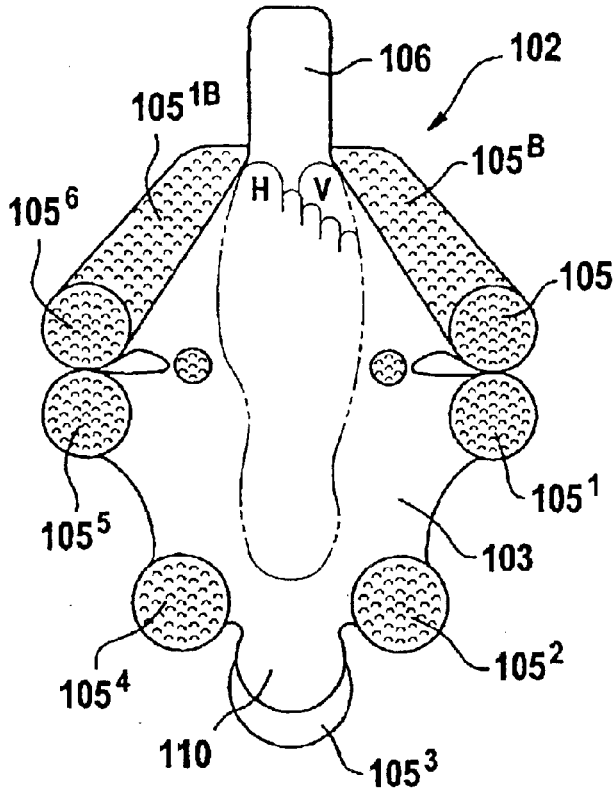
FIGS. 9 and 10 respectively show the inside and the outside of a variant of the shoe upper part in the extended position.
Figure 10:
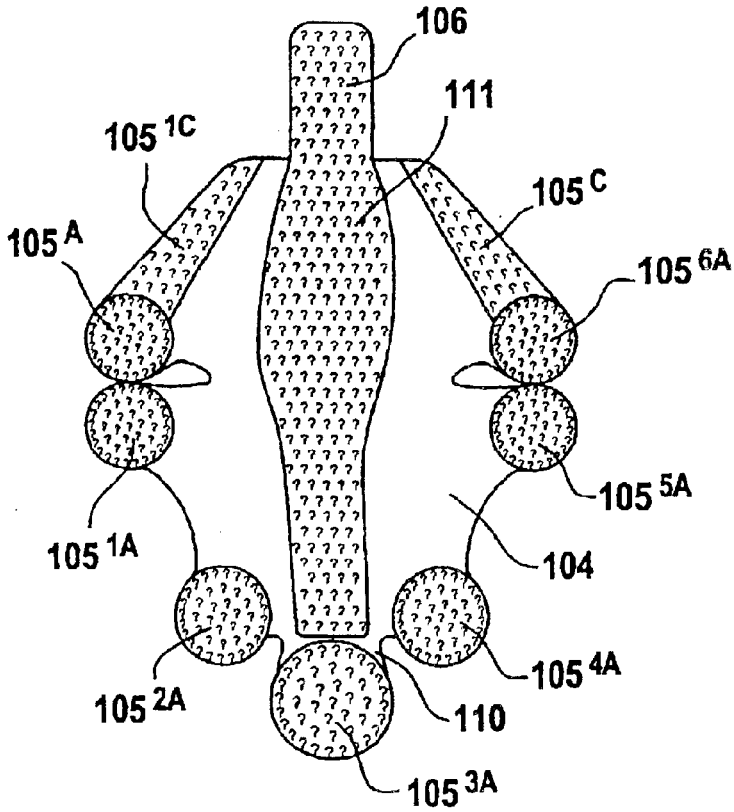

The upper part 102 of the shoe illustrated in the drawings in FIGS. 9 and 10 exhibits fastening devices in the form of circular hook and loop-type attachment devices 105—105 in $\mathbf{105}^A$—$\mathbf{105}^A$ and with elongated loop attachment devices $\mathbf{105}^B$, $\mathbf{105}^{1B}$, $\mathbf{105}^C$, $\mathbf{105}^{1C}$ extending along the sides of the foot respectively on the inside 103 and on the outside 104 of the envelope 102. Inward-facing fastening devices exhibit soft loops, while outward-facing fastening devices exhibit harder hooks.

The toe part 106 and the heel part 110 are formed from the pliable flexible material in the upper part 102 of the shoe, which externally 104 exhibits an elongated strip of a fastening device 111 in the form of hooks.

Figure 11:
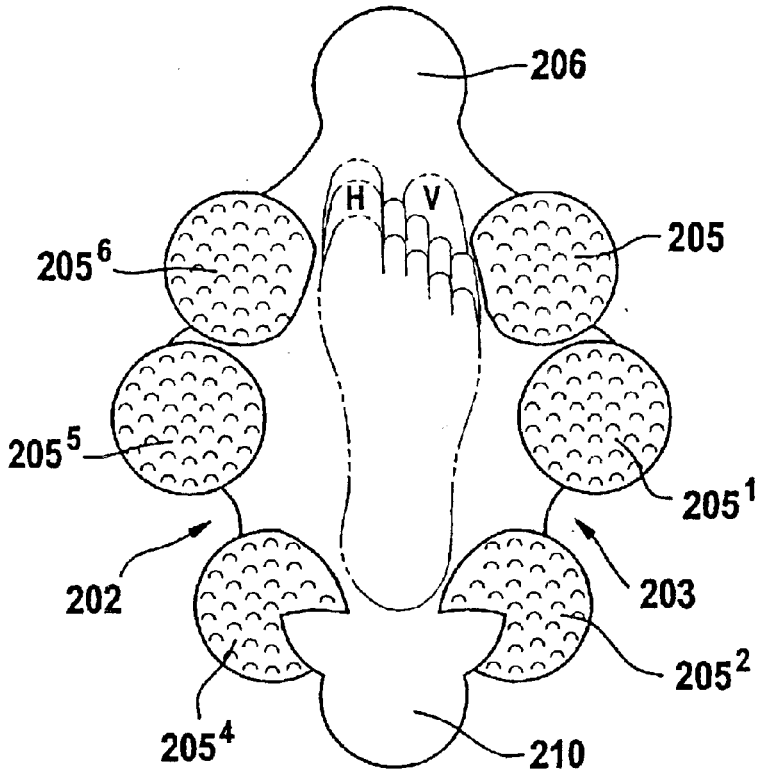
FIGS. 11 and 12 show a further variant of a shoe upper part in the extended position viewed from the inside and the outside.
Figure 12:
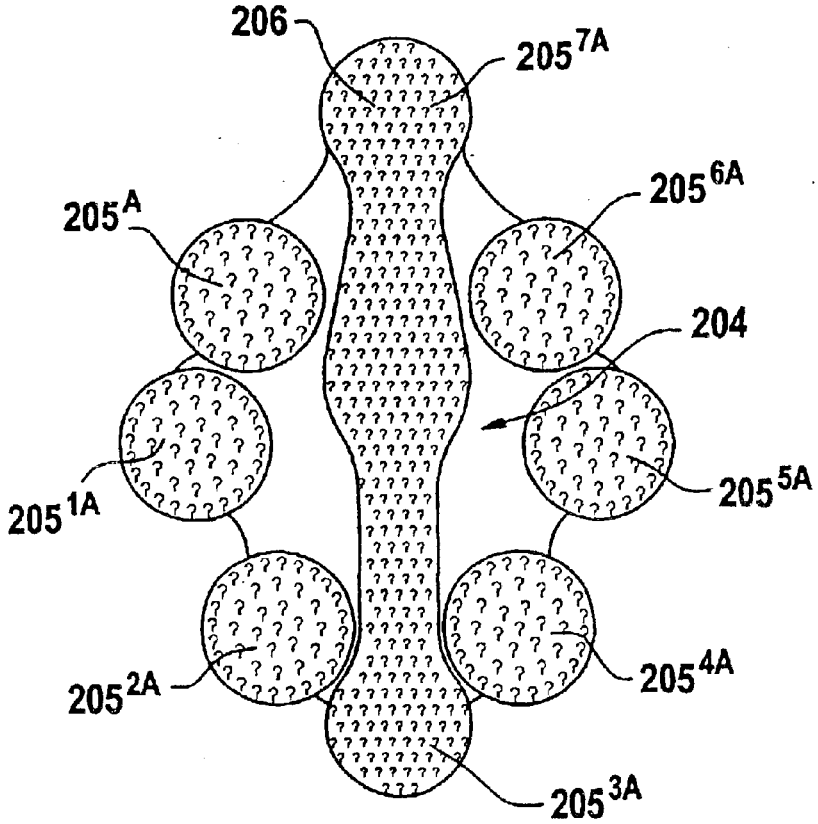

The upper part 202 of the shoe illustrated in FIGS. 11–12 exhibits circular soft fastening devices 205–$\mathbf{205}^6$ with Velcro loops on the inside 203, apart from at the toe part 206 and the heel part 210, and with circular fastening devices $\mathbf{205}^A$–$\mathbf{205}^{7A}$ on the outside 204 of the upper part 202 with hooks. The size of the circles may be a diameter of between 30 and 100 mm for each circular fastening device.

More preferably, they are between 80 and 100 mm, and most preferably 90 mm.

The under side of this upper part is also in the form of a centrally located part 211 provided with a Velcro fastening device in the form of hooks.

The execution of all, or at least a majority, of the fastening devices in the form of identical, or essentially identical, circular hook and loop fastening devices offers the possibility of increasing the adjustability for different sizes of feet, and even of rotating the upper part through a full 180 degrees so that the toe part and the heel part change place. The invention is also superior to having a pull-on stocking as the upper part, since it is now possible to vary the tightening pressure at so many points.

As with conventional shoes, what is now obtained is a fastening part on the foot at its instep part with a number of mutually overlapping fastening devices. It must also be mentioned that the side pieces 50, 51 can exhibit slots 52, 53 as parts of these in order to permit greater adjustability.

The invention is not restricted to illustrative embodiments described above and shown in the drawings, but may be varied within the scope of the patent claims without departing from the idea of invention.

What is claimed is:

1. A shoe (19) comprising an upper part (2) for enclosing a foot (10), said upper part made out of a pliable flexible material having:

a fold-up toe part (6), a fold-up heel part (7), and a plurality of fastening devices distributed around a periphery of the upper part to form an envelope enclosing the foot (10);

said fastening device comprising:

hook and loop-type fastening devices, at least some of said fastening devices being circular in form;

said upper part having an underside (4) on an outside of the upper part, said underside (4) comprising connecting devices (18) essential for attachment to a sole (15, 16).

2. A shoe in accordance with claim 1, further characterized in that the toe part (6) and the heel part (7) are each in the form of a folding flap on the upper part (2) of the shoe, in that at least one fastening device is arranged on the toe part and at least one fastening device is arranged heel part, and in that fastening devices are distributed along opposite side pieces of the upper part of the shoe.

3. A shoe in accordance with claim 2, characterized in that the toe part is in the form of a single folding flap on the front part of the upper part of the shoe.

4. A shoe in accordance with claim 2, characterized in that the fastening devices are in the form of circular folding edge parts situated on a front part a rear part and a central part of the upper part of the shoe.

5. A shoe in accordance with claim 1, characterized in that the toe part is in the form of a single folding flap on the front part of the upper part of the shoe.

6. A shoe in accordance with claim 5, characterized in that the fastening devices are in the form of circular folding edge parts situated on a front part a rear part and a central part of the upper part of the shoe.

7. A shoe in accordance with claim 1, characterized in that the fastening devices are in the form of circular folding edge parts situated on a front part, a rear part and a central part of the upper part of the shoe.

8. A shoe in accordance with claim 7, characterized in that three circular fastening devices are situated on the front part of the upper part of the shoe.

9. A shoe in accordance with claim 8, characterized in that three circular fastening devices are situated on the rear part of the upper part of the shoe.

10. A shoe in accordance with claim 8, characterized in that pairs of circular fastening devices are situated on the central part of the upper part of the shoe.

11. A shoe in accordance with claim 8, characterized in that the circular fastening devices exhibit a diameter of between 30 and 1000 mm.

12. A shoe according to claim 11 wherein the circular fastening devices exhibit a diameter between 30 and 100 mm.

13. A shoe according to claim 11 wherein the circular fastening devices exhibit a diameter between 80 and 100 mm.

14. A shoe according to claim 11 wherein the circular fastening devices exhibit a diameter between 80 and 100 mm.

15. A shoe in accordance with claim 8, characterized in that laterally situated fastening devices exhibit male hook fastening devices on one side and loop fastening devices on the other side.

16. A shoe in accordance with claim 8, characterized in that the longitudinal, centrally located part of the upper part of the shoe is in the form of a downward-facing part provided with hook and loop fastening devices.

17. A shoe in accordance with claim 7, characterized in that three circular fastening devices are situated on the rear part of the upper part of the shoe.

18. A shoe in accordance with claim 17, characterized in that pairs of circular fastening devices are situated on the central part of the upper part of the shoe.

19. A shoe in accordance with claim 6, characterized in that the circular fastening devices exhibit a diameter of between 30 and 1000 mm.

20. A shoe according to claim 19 wherein the circular fastening devices exhibit a diameter between 30 and 100 mm.

21. A shoe according to claim 19 wherein the circular fastening devices exhibit a diameter between 30 and 100 mm.

22. A shoe according to claim 19 wherein the circular fastening devices exhibit a diameter between 30 and 100 mm.

23. A shoe in accordance with claim 7, characterized in that pairs of circular fastening devices are situated on the central part of the upper part of the shoe.

24. A shoe in accordance with claim 7, characterized in that the circular fastening devices exhibit a diameter of between 30 and 1000 mm.

25. A shoe according to claim 24 wherein the circular fastening devices exhibit a diameter between 30 and 100 mm.

26. A shoe according to claim 24 wherein the circular fastening devices exhibit a diameter between 80 and 100 mm.

27. A shoe according to claim 24 wherein the circular fastening devices exhibit a diameter between 90 and 95 mm.

28. A shoe in accordance with claim 7, characterized in that laterally situated fastening devices exhibit hook fastening devices on one side and loop fastening devices on the other side.

29. A shoe in accordance with claim 7, characterized in that the longitudinal, centrally located part of the upper part of the shoe is in the form of a downward-facing part provided with hook and loop-type fastening devices.

30. A shoe according to claim 1 wherein the material is a woven fabric.

31. A shoe according to claim 1 wherein the upper part (2) is detachably attachable to the sole (15, 16).

* * * * *